US011332280B2

(12) United States Patent
De Gavelle De Roany et al.

(10) Patent No.: US 11,332,280 B2
(45) Date of Patent: May 17, 2022

(54) BOTTLE IN PARTICULAR FOR BEVERAGES, IN PARTICULAR FOR ALCOHOLIC BEVERAGES, OR FOR COSMETIC PRODUCTS OR FRAGRANCES

(71) Applicant: GREEN GEN TECHNOLOGIES, Toulouse (FR)

(72) Inventors: James De Gavelle De Roany, Toulouse (FR); Severine Laurent, Toulouse (FR)

(73) Assignee: GREEN GEN TECHNOLOGIES, Toulouse (FR)

( * ) Notice: Subject to any disclaimer, the term of this patent is extended or adjusted under 35 U.S.C. 154(b) by 0 days.

(21) Appl. No.: 16/771,012

(22) PCT Filed: Dec. 13, 2018

(86) PCT No.: PCT/FR2018/053272
§ 371 (c)(1),
(2) Date: Jun. 9, 2020

(87) PCT Pub. No.: WO2019/115961
PCT Pub. Date: Jun. 20, 2019

(65) Prior Publication Data

US 2021/0163180 A1 Jun. 3, 2021

(30) Foreign Application Priority Data

Dec. 15, 2017 (FR) ..... 1762244

(51) Int. Cl.

| | |
|---|---|
| ***B65D 65/46*** | (2006.01) |
| ***B65D 23/08*** | (2006.01) |
| ***B65D 1/02*** | (2006.01) |
| ***B65D 41/04*** | (2006.01) |
| ***B65D 77/06*** | (2006.01) |

(52) U.S. Cl.
CPC ..... *B65D 23/0885* (2013.01); *B65D 1/0207* (2013.01); *B65D 1/0246* (2013.01); *B65D 41/04* (2013.01); *B65D 77/062* (2013.01)

(58) Field of Classification Search
CPC ..... B65D 23/0885; B65D 1/0207; B65D 1/0246; B65D 41/04; B65D 77/062; B32B 13/02; B32B 2307/7163; B32B 23/04
USPC ..... 215/12.1; 220/660; 206/524.7
See application file for complete search history.

(56) References Cited

U.S. PATENT DOCUMENTS

| | | | | |
|---|---|---|---|---|
| 2,305,896 A * | 12/1942 | Prati | B65D 23/08 215/12.1 |
| 5,738,921 A * | 4/1998 | Andersen | B28B 11/003 428/36.4 |
| 8,701,905 B2 * | 4/2014 | Warner | B65D 65/466 215/12.2 |
| 2010/0044267 A1 * | 2/2010 | Tolibas-Spurlock | B65D 65/466 206/524.7 |

FOREIGN PATENT DOCUMENTS

| | | |
|---|---|---|
| FR | 2549009 A1 | 1/1985 |
| FR | 3041329 A1 | 3/2017 |
| GR | 2426506 A | 11/2006 |
| WO | 2017051320 A1 | 3/2017 |

OTHER PUBLICATIONS

International Search Report for International Application No. PCT/FR2018/053272.
Written Opinion of International Application No. PCT/FR2018/053272 dated Apr. 17, 2019.

* cited by examiner

*Primary Examiner* — Don M Anderson
*Assistant Examiner* — Elizabeth J Volz
(74) *Attorney, Agent, or Firm* — Renner, Kenner, Greive, Bobak, Taylor & Weber

(57) ABSTRACT

The invention relates to a bottle having: firstly a rigid external shell, which has a shell body continued by a neck provided with a neck opening, and is equipped with a cap that is fitted on the neck opening and has a threaded internal annular part inside this neck opening, this shell being made of a cylindrical braid of vegetable fibres having a uniform appearance over the entire body of the shell and of the neck, said braid covering at least 90% of the surface thereof and being inserted into an impregnation matrix made of a thermoplastic resin, and secondly an internal container intended to come into contact with the beverage, said internal container being fastened to the internal annular part of the cap and being made of a thermoplastic material.

7 Claims, No Drawings

BOTTLE IN PARTICULAR FOR BEVERAGES, IN PARTICULAR FOR ALCOHOLIC BEVERAGES, OR FOR COSMETIC PRODUCTS OR FRAGRANCES

The invention relates to a bottle, in particular for beverages, especially alcoholic beverages or for cosmetic products or fragrances.

This bottle can have any shape, classic or otherwise, without extending beyond the scope of the invention.

Such a bottle may, for example, contain beer, still or sparkling wines, or spirits with a high alcohol content of up to 60% such as whiskey, cognac, Armagnac, rum, gin, vodka, jenever, etc.

Traditionally, drinks like this are packaged in glass bottles, the appearance of which is often questionable, which have the drawback of being heavy and not mechanically strong and whose production also demands much energy, with the spinoff of a very unfavourable carbon footprint.

To correct these drawbacks, the idea behind the invention was reached of packaging drinks or cosmetic products or fragrances in special bottles comprising firstly a rigid external weighing less than 0.5 g/cm2 making the bottle mechanically strong, and secondly an internal container intended to come into contact with the beverage or cosmetic product, being made of a thermoplastic material approved for food contact by the Authorities.

According to the invention, the rigid shell comprises a shell body extending in a neck provided with a neck opening and a lower cover and is equipped with a cap that fitted on the neck opening, attached to it and comprising an external annular part and a threaded internal annular part being inserted into the neck opening.

The container intended to come into contact with the beverage or cosmetic product is fixed to the internal annular part of this cap.

The shell comprises a cylindrical braid of plant fibres with a burning temperature above 140° C., having a uniform appearance over the entire body of the shell and neck and covering at least 90% of their surface area.

This cylindrical braid, preferably obtained by braiding a fibre on a mandrel, is inserted in an impregnation matrix made of a thermoplastic resin whose melting temperature is less than or equal to 190° C.

Note that in accordance with the invention the term "cylindrical" is to be interpreted very broadly and may refer to any volume having a closed circular or non-circular cross-section.

According to a first variant of the invention, the container intended to come into contact with the beverage or cosmetic product is a polyethylene terephthalate (PET) container of a specific shape fitted to the lower part of the internal annular part of the cap.

According to this first variant of the invention, the bottle can be obtained for instance by an injection blow-moulding process from three parts previously manufactured by injection, namely a cap, a lower cap and an impregnation matrix in the shape of the bottle, as well as a cylindrical braid of vegetable fibres also in the shape of the bottle, and an off-the-shelf PET container.

In this method, the cylindrical braid of plant fibres is positioned on an inflatable bladder, in particular made of silicone and the impregnation matrix is tight-fitted to the external face of this braid, then the assembly thus formed is inserted into a mould to obtain the body of the shell.

The equipped mould is then heated, and the inflatable bladder is put under pressure so that the thermoplastic resin forming the matrix impregnates the vegetable fibre braid.

After cooling and mould-releasing of the shell body, the cap is fitted to its neck, the PET container is inserted in the internal part and attached to the cap, then the production of the shell body is completed by attaching the lower cap.

In a second variant of the invention, the container intended to come into contact with the beverage or cosmetic product is a soft and flexible pouch, in particular made of polyethylene (PE), attached to the lower part of the internal annular part of the cap during its manufacture and inflated, in particular with compressed air, after the manufacture of the shell body, the attaching of the cap to it and preferably the attaching of the lower cap.

Note that the soft and flexible pouch may have a single-layer or multi-layer structure.

In accordance with this second variant of the invention, the shell body can also be manufactured by an injection blow-moulding process of the above-mentioned type.

According to another characteristic of the invention, the thermoplastic resin forming the impregnation matrix is selected from among the following resins: PE, polypropylene (PP), PET and polylactic acid (PLA).

It is essential to choose a thermoplastic resin that has a melting temperature lower than the burning temperature of the plant fibres forming the cylindrical braid.

Note that polypropylene is particularly advantageous because of its low cost and ease of forming but has the disadvantage of not generally being biodegradable and impossible to manufacture without synthetic products, exclusively from the biomass.

However, this disadvantage is mitigated by the fact that the thermoplastic resin represents less than 10% of the shell weight.

Polylactic acids, which are more expensive than polypropylene, have the advantage of being biodegradable under some conditions.

These acids are more precisely resistant to degradation under normal temperature and humidity conditions, but a temperature above 60° C. in a very humid environment causes the degradation of their polymer chains causing oligomers to form and which can then be degraded when exposed to microorganisms (enzymes or bacteria).

Consequently, bottles conforming to the invention, the impregnation matrix of which consists of PLA, can be degraded by grinding followed by a dwell period in an industrial fermenter or composter.

According to another feature of the invention, the diameter of the bottle shell varies between about 30 mm and about 90 mm, and the braiding angle of the fibre forming the cylindrical braid varies between 25° and 65° along this shell so as to obtain a uniform appearance over the entire surface of the shell body and the neck.

Note that the fibre braiding angle depends on the number of filaments and the final diameter to be obtained while the variations of the braiding diameter and the fibre orientation depend on the braiding speed and therefore on the feed speed of the mandrel.

According to another feature of the invention, the cylindrical vegetable fibre braid comprises hemp fibres, bamboo fibres, rice fibres or flax fibres.

A braid like this can advantageously be formed of a flax fibre braid a diameter of having about 0.3 mm and comprising 90 to 100 filaments, in particular 96 filaments each embodying 5 fibres.

A braid of this type has a density of less than 1400 kg/m3 and in the case of a conventional beverage bottle, weighs about 35 grams and is therefore particularly light.

As an example, the fibres of a cylindrical flax fibre braid forming a bottle as per the invention may have the following physical characteristics, in pure traction and compression-bending:

pure traction:

modulus of elasticity parallel to the fibres: 61 GPa, modulus of elasticity perpendicular to the fibres: 6.4 GPA maximum stress parallel to the fibres: 580 MPA elongation before breakage parallel to the fibres: 1%, compression bending:

modulus of elasticity parallel to the fibres: 57 GPA modulus of elasticity perpendicular to the fibres: 6.3 GPA maximum stress parallel to the fibres: 663 MPA

The invention claimed is:

1. A bottle for beverages or for cosmetic products or fragrances, the bottle comprising, a rigid external shell weighing less than 0.5 g/cm$^2$ ensuring the mechanical strength of the bottle, the rigid external shell comprising a shell body extended by a neck provided with a neck opening and a lower cap, a cap made of a rigid material being fitted onto the neck opening, the cap made of the rigid material being attached to the neck opening and comprising an external annular part, and an internal annular part threaded inside the neck opening, the rigid external shell being made of a cylindrical braid of plant fibres, the cylindrical braid of plant fibres having a burning temperature higher than 140° C., having a uniform appearance over the whole of the shell body and the neck, covering at least 90% of a surface of the shell body and the neck, and being inserted in an impregnation matrix made of a thermoplastic resin whose melting temperature is less than or equal to 190° C., and an internal container adapted to come into contact with the beverage or the cosmetic product, the internal container being fastened to the internal annular part of the cap made of the rigid material and being made of a thermoplastic material.

2. The bottle of claim 1, wherein the cylindrical braid of plant fibres comprises hemp fibres, bamboo fibres, rice fibres, or flax fibres.

3. The bottle of claim 1, wherein a diameter of the rigid external shell varies between about 30 mm and about 90 mm, and a braiding angle of the plant fibres forming the cylindrical braid varies between 25° and 65° along the rigid external shell so as to obtain the uniform appearance over the entire surface of the shell body and the neck.

4. The bottle of claim 3, wherein the cylindrical braid of plant fibres is a flax fibre braid having a diameter of about 0.3 mm and comprises 90 to 100 filaments each including 5 fibres.

5. The bottle of claim 1, wherein the thermoplastic resin forming the impregnation matrix is selected from the following resins: PE, PP, PLA and PET.

6. The bottle of claim 1, wherein the container adapted to come into contact with the beverage or the cosmetic product is a PET container fastened to the internal annular part of the cap.

7. The bottle of claim 1, wherein the container adapted to come into contact with the beverage or the cosmetic product is a soft and flexible pouch made of PE fastened to the lower part of the internal annular part of the cap and is inflated with compressed air.

* * * * *